United States Patent [19]

Hafers

[11] Patent Number: 5,074,090

[45] Date of Patent: Dec. 24, 1991

[54] SELF-SUPPORTIVE REFLECTIVE INSULATION

[75] Inventor: Louis Hafers, Carlsbad, Calif.

[73] Assignee: Lucas Curry Wall, Jr., Tustin, Calif.

[21] Appl. No.: 522,912

[22] Filed: May 14, 1990

[51] Int. Cl.[5] ..... E04B 2/00

[52] U.S. Cl. ..... 52/406; 52/799; 52/806

[58] Field of Search ..... 52/406, 799, 407, 802, 52/805, 806, 404, 809, 810, 743, 745; 428/36.92

[56] References Cited

U.S. PATENT DOCUMENTS

| | | | |
|---|---|---|---|
| 1,651,539 | 12/1927 | Olson . | |
| 1,726,040 | 8/1929 | Olson . | |
| 1,913,312 | 6/1933 | Lines . | |
| 1,954,582 | 4/1934 | Aschenbrener | 20/4 |
| 1,956,323 | 4/1934 | Gregg | 52/799 X |
| 1,963,609 | 6/1934 | Balduf et al. | 52/407 |
| 2,101,836 | 12/1937 | Benedict | 154/45 |
| 2,750,313 | 6/1956 | Schwartz et al. | 154/45 |
| 2,786,004 | 3/1957 | Schwartz et al. | 52/406 X |
| 2,906,655 | 9/1959 | Blumenstein | 154/45 |
| 2,911,076 | 11/1959 | Saunders et al. | 52/802 X |
| 2,913,104 | 11/1959 | Parker | 52/406 X |
| 4,084,366 | 4/1978 | Saylor et al. | 52/806 X |
| 4,525,968 | 7/1985 | Fricker et al. | 52/406 X |
| 4,808,457 | 2/1989 | Kruck et al. | 52/406 X |

*Primary Examiner*—David A. Scherbel
*Assistant Examiner*—Creighton Smith
*Attorney, Agent, or Firm*—Brown, Martin, Haller & McClain

[57] ABSTRACT

The reflective insulation unit has a rigid frame consisting of a four-sided corrugated cardboard structure which is generally rectangular in cross-section, the top and bottom being sized to closely fit within the dimensions of a construction bay. Multiple sheets of paper and foil are attached to the inside surfaces of the sides so that the sheets are parallel to the top and bottom of the frame and to each other with a fixed spacing between the sheets. For shipping and storage purposes the frame may be folded at the corners and flattened so that the sides become parallel with the top, bottom and sheets. For installation, with the sides at right angles to the top and bottom, end pieces consisting of corrugated cardboard of the same dimension as the cross-section of the frame with tabs or flaps folded at its edges are inserted into the open ends of the frame forming the fifth and sixth sides of a box and creating a self-framed insulating unit. The completed insulating unit may be set in place between the beams of the structure without any means of fastening to the beam, but merely a support to prevent the unit from falling.

16 Claims, 2 Drawing Sheets

SELF-SUPPORTIVE REFLECTIVE INSULATION

BACKGROUND OF THE INVENTION

I. Field of the Invention

The present invention relates to insulation for use in buildings, houses, vehicles, boxes and the like, and more specifically to reflective insulation.

II. Background Art

Reflective insulation employs thin sheets which have heat reflective metal surfaces in conjunction with air spaces adjacent to them to provide reflective insulation, with the resulting structure being very effective against radiative heat transmission, as well as conduction and convection. Insulation of this type is low cost with regard to the materials required, which are usually merely aluminum foil and paper. It is also economical for shipping, packaging, storage and handling because it is collapsible, folding into a flat, stackable unit.

Constant spacing between the sheets of paper and foil are critical to the effectiveness of the reflective insulation. Because the foil is conductive, it must not be allowed to touch any other conductive surface, thus the reason for the alternating layers of paper and foil. In addition, it is also important that the air space itself between the paper and foil be kept constant. The most common method of maintaining the spacing between the sheets is to stretch the insulation between two beams, attaching the ends with a fastener such as a nail or staple, with the idea of holding the sheets under tension longitudinally so they remain parallel. If the sheets are maintained under excessive tension, however, their lifetime may be shortened because the sheets may tear or collapse after being subjected to repeated shock or vibration. Attempts to support the spaces by insertion of intermediate foundation layers which divide the air spaces into triangular sections, as in U.S. Pat. No. 2,786,004 of Schwartz, et al., decreases the insulating value of the reflective air space.

One of the greatest drawbacks of reflective insulation is that methods of fastening the insulation to the structure place the ends of the insulation under forces which at least partially compress the spaces adjacent to the supporting edge, resulting in weak thermal resistance at that point. Unfortunately, all currently available reflective insulation requires attachment of the supporting edge to the beams of a construction bay, the construction bay being the space between studs, beams, rafters, purlins, etc. in the structure being insulated.

Another drawback is that when buildings are used as storage facilities the insulation is often left unprotected from the inside, exposing the fragile sheets of foil and paper to damage due to inadvertent contact with objects in the building.

It would be desirable to provide a reflective insulation unit which is collapsible for ease in transportation and storage and which, when installed, provides continuously extending sheets which remain parallel and are maintained taut over the entire width of the insulation unit in proper spaced relationship without relying on attachment to the beams of the structure being insulated. It is also desirable to provide a protective housing for the reflective insulation to enhance its lifetime and effectiveness and not requiring the open ends to be butted against purlins, studs, or trusses in order for the product to perform.

SUMMARY OF THE INVENTION

It is an advantage of the present invention to provide a reflective insulation unit which is self-contained, self-enclosed and self-supportive, being capable of maintaining the sheets of insulating and conducting material at a constant spacing without requiring attachment to the beams of the structure being insulated. It is a further advantage to provide a reflective insulation product for metal buildings, that is applicable without first having to frame the underside of the metal roof structure.

In the preferred embodiment, the reflective insulation unit has a rigid frame consisting of a four-sided corrugated cardboard structure which is generally rectangular in cross-section, the top and bottom being sized to closely fit within the dimensions of the construction bay. Multiple sheets of paper and foil are attached to the inside surfaces of the sides so that the sheets are parallel to the top and bottom of the frame and to each other with a fixed spacing between the sheets. For shipping and storage purposes the frame may be folded at the corners and flattened so that the sides become parallel with the top, bottom and sheets. For installation, with the sides at right angles to the top and bottom, end pieces consisting of corrugated cardboard of the same dimension as the cross-section of the frame with tabs or flaps folded at its edges are inserted into the open ends of the frame forming the fifth and sixth sides of a box and creating a self-framed insulating unit. The completed insulating unit may be set in place between the beams of the structure without any means of fastening to the beam, but merely a support to prevent the unit from falling.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF THE PREFERRED EMBODIMENT

Figure 1:
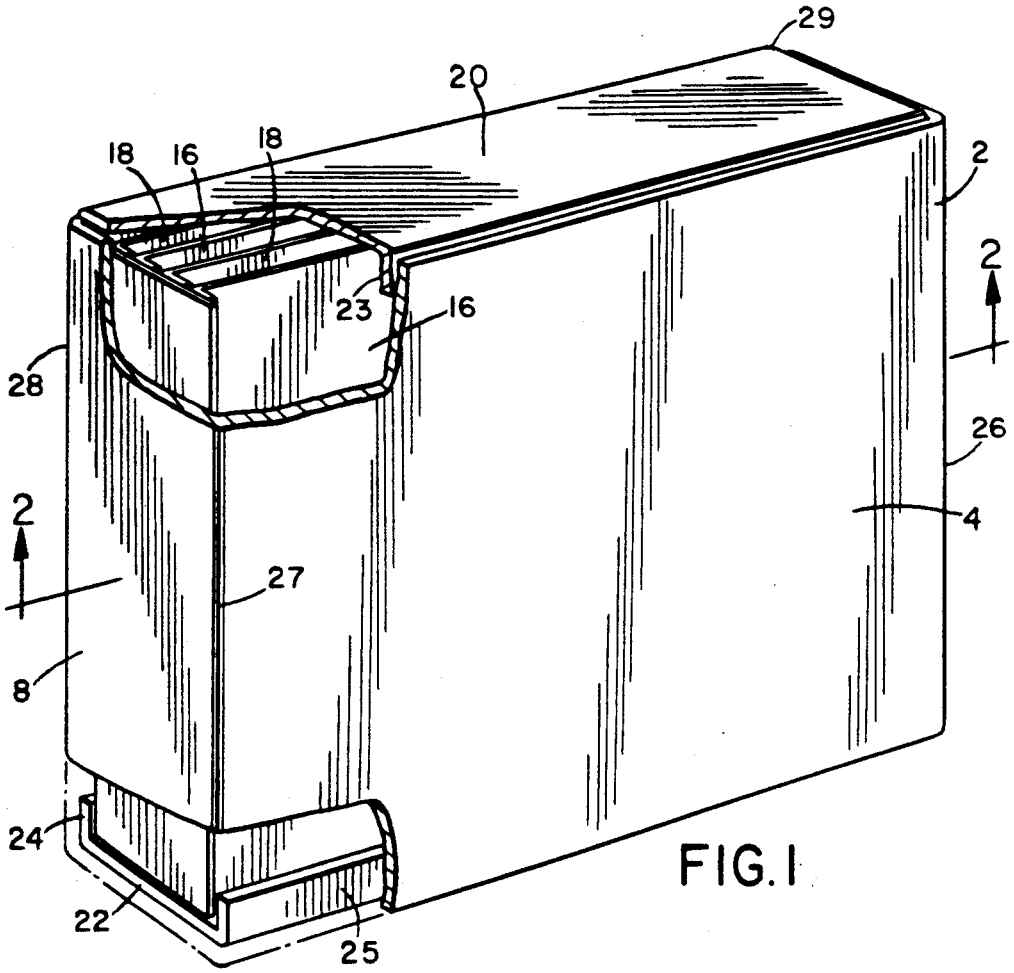
FIG. 1 is a perspective view of an erected insulation unit, with portions cut away.
Figure 2:
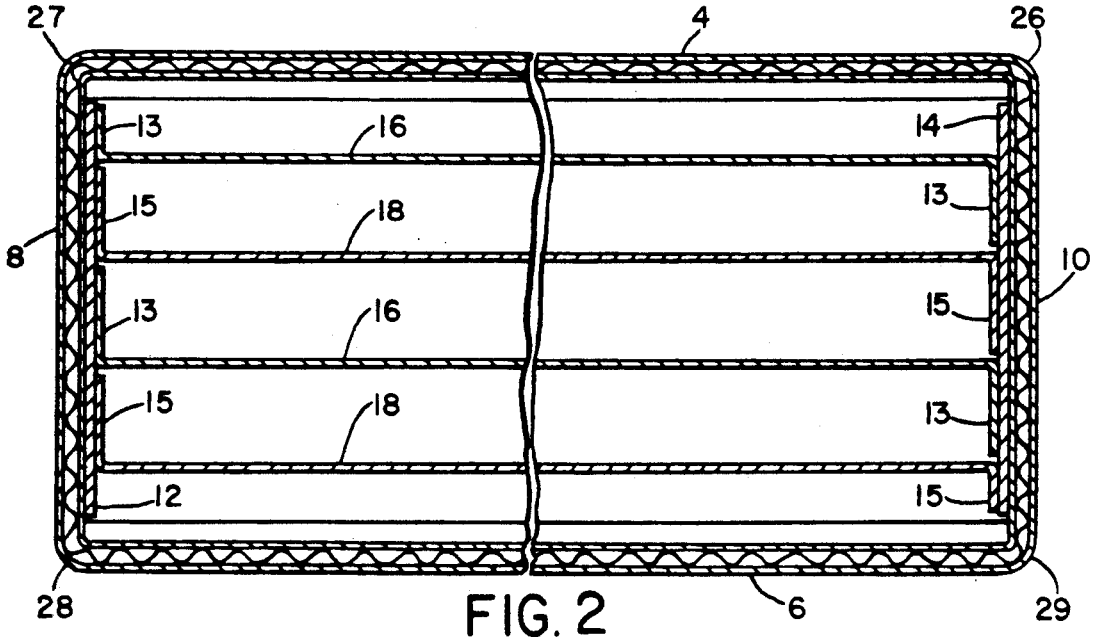
FIG. 2 is an enlarged sectional view taken on line 2—2 of FIG. 1.

With reference to FIGS. 1 and 2, a frame 2 has a top 4 and bottom 6 which are broad and flat, and sides 8 and 10 with a relatively narrow width. Attached to the inside surfaces 12 and 14 of the sides 8 and 10 are reflective sheets 16 and insulating sheets 18, with the sheets 16 and 18 parallel to the top 4 and bottom 6 and to each other, separated by a constant air space. End pieces 20 and 22 have tabs 23, 24 and 25 which are inserted into frame 2 to serve as the fifth and sixth sides of a box, respectively.

Figure 3:
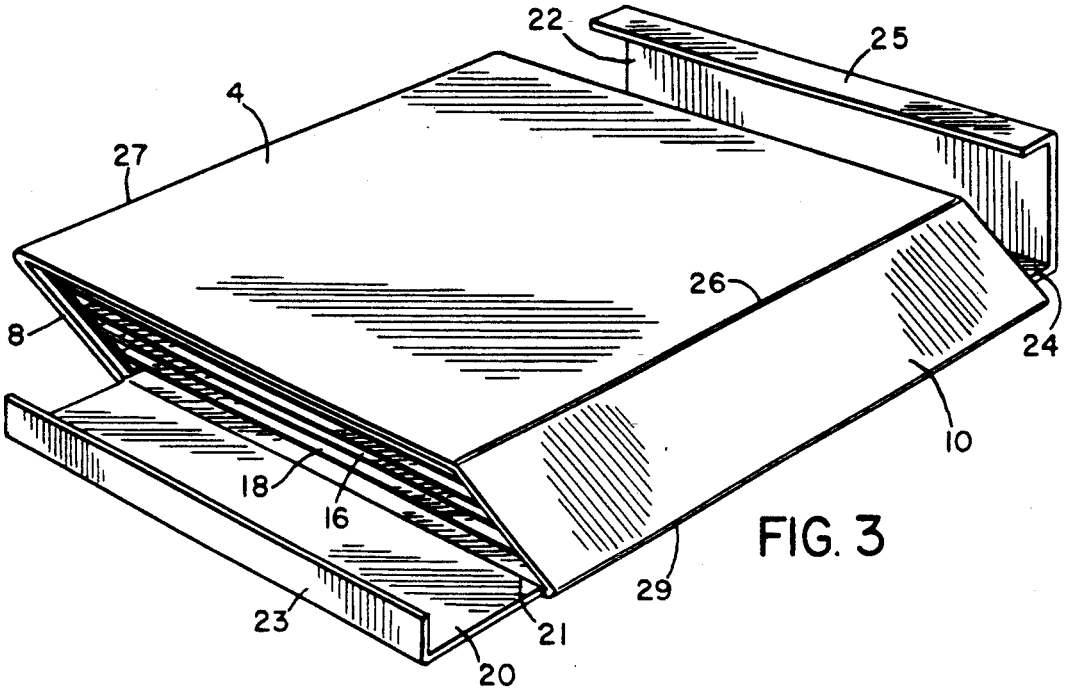
FIG. 3 is a perspective view of the insulation unit partially collapsed.

Frame 2 is preferably constructed of corrugated cardboard for economy, but other rigid material such as plastics or pressed board may be used, with the primary limitation being that the frame 2 be rigid enough to be self-supporting, and that corners 26, 27, 28 and 29 can be formed so that the frame can be compressed flat for shipping and storage, as shown by the partially compressed insulation unit in FIG. 3.

Figure 4:
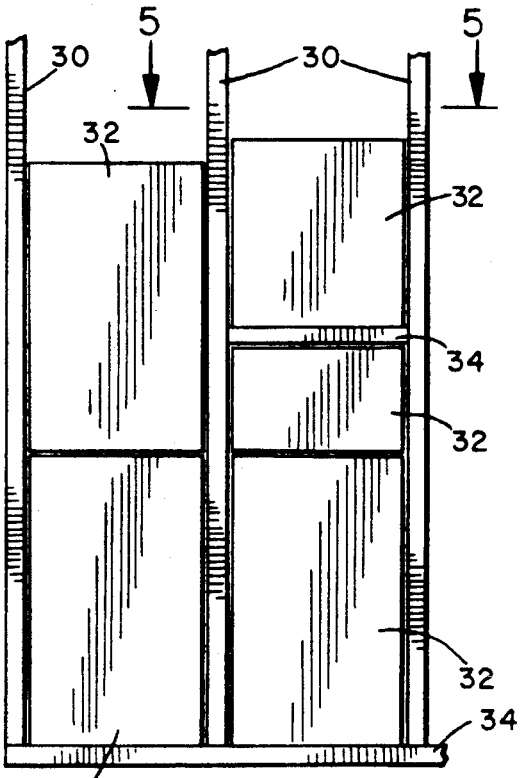
FIG. 4 illustrates two construction bays with several insulation units installed.
Figure 5A:
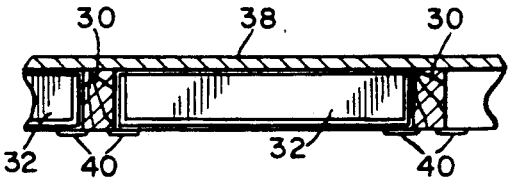
FIG. 5 is an enlarged sectional view taken on line 5—5 of FIG. 4 showing alternate configurations of construction bays, with FIG. 5*a* showing a bay framed by beams and FIG. 5*b* showing a bay framed by subpurlins.
Figure 5B:
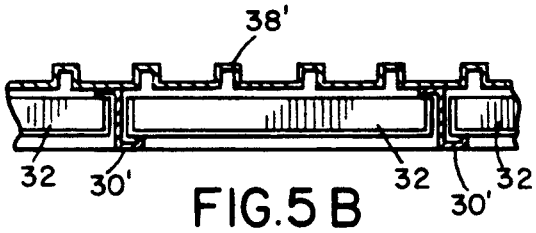

As shown in FIGS. 4 and 5, top 4 and bottom 6 have widths which closely fit between the beams 30 or sub-purlins 30' of the construction bay of the structure to be insulated. The lengths may be variable, as the insulation units 32 may be placed side-to-side within the construction bay. The top 4, which will be facing the exterior wall 38 and 38' of the structure, usually a metal building, as shown in FIG. 5*b*, is covered with a heat-reflective sheet such as aluminum foil.

The depths of the sides 8 and 10 are determined by the depth of beams 30 of the construction bay, so that the insulation unit 32 is substantially flush with the innermost extension of beam 30, as shown in FIG. 5.

Folded extensions 13 and 15 at the longitudinal edges of the sheets 16 and 18 are attached by adhesive, staples, stitching or the like to the inside surfaces 12 and 14 of sides 8 and 10. The sheets are attached so that a constant distance is maintained between them across their full length, forming the reflective air space. A reflective sheet 16 is placed closest to the top 4 so that it will be facing out toward the exterior wall 38 of the structure. The reflective sheets 16 are reflective and serve to prevent convection currents and heat rays from transmitting heat across the construction bay. The reflective sheets 16 are formed of a sheet of aluminum foil or of foil laminated on paper with the foil side facing outward toward the top 4 if the foil is laminated on only one side. Alternating with the reflective sheets 16 are insulating sheets 18 formed of paper, plastic or a composite which is preferably treated to be fire-retardant. The placement of insulating sheets 18 between the reflective sheets 16 inhibits conduction of heat between the reflective sheets 16. The spaces formed between the reflective and insulating sheets trap and reflect heat back out through the top 4. The number of sheets may be varied, with more sheets providing a higher R-value or insulating efficiency.

For shipping and storage, the frame may be collapsed, as shown by the partially collapsed frame in FIG. 3, into a flat unit by folding corners 27 and 29 to form acute angles and expanding corners 26 and 28 to be substantially straight. The spaces between sheets 16 and 18 will become collapsed and the sheets will lie flat against each other, sandwiched between the combined lengths of top 4 and side 10, and bottom 6 and side 8.

End piece 20 is shown as an attached flap extending from the bottom 6 with a tab 23 folded inward. When the frame 2 is expanded so that all corners 26–29 are 90°, end piece 20 is folded along corner 21 and tab 23 is inserted into the frame to form the fifth side of a box.

The sixth side of the box may be formed similarly with an attached end piece extending from the opposite end of the top 4 or bottom 6.

Preferably, however, a separate end piece 22, shown in FIG. 1, is formed as a cap with the same length and width as end piece 20 and two tabs 24 and 25 running along the length which are inserted into the frame 2 at the top and bottom to form the sixth side of the box. The fifth side can also be formed in this manner as an alternative. Having at least one separable end piece formed in this manner permits the length of the frame to be custom fit to the construction bay without cutting off an end flap.

The corrugated cardboard of which the frame is made, the insulating sheets and any adhesive or stitching used to assemble the insulation unit are preferably treated to be fire retardant. In addition, any coating applied to the bottom of the unit for finishing purposes should also be flame retardant.

After the insulation unit 32 is formed into a box it may be slid into place between beams 30 or sub-purlins 30' of the construction bay, being held in place against the exterior wall or roof 38, 38' by a simple bracket 40 extending from the beam 30 or the Z-shaped sub-purlin 30'. No attachment of the insulation unit 32 to the beam 30 is necessary to maintain the air space between the reflective and the insulating sheets at an optimum uniform distance. As shown in FIG. 4, several insulation units 32 are positioned side-to-side to fill the construction bay. Since the insulation units 32 can be placed against each other, there is minimal loss of effectiveness due to gaps between the units. The self-supporting insulation unit 32 maintains constant spacing between the beams 30 with no sagging or pulling away from the lateral beams 34 in the center of the unit. The rigid structure of the frame protects the sheets inside, providing a durable and uniformly effective insulation unit.

It will be evident that there are additional embodiments which are not illustrated above but which are clearly within the scope and spirit of the present invention. The above description and drawings are therefore intended to be exemplary only and the scope of the invention is to be limited solely by the appended claims.

I claim:

1. An insulating unit for installation in a construction bay of a structure comprising:

a frame comprising a rigid sheet-like material and having a top, a bottom, and two sides, said top and said bottom having a first length adapted to closely fit said construction bay and said sides having a first height which is generally the same as a depth of said construction bay;

a plurality of sheets having two longitudinal ends, each longitudinal end being fastened to an inside surface of one of said sides in a fixed spaced relationship, at least one sheet of said plurality of being a heat-reflective sheet, each of said plurality of sheets having a single fold at each longitudinal end, said single fold being fastened to said inside surface of said side adjacent to said longitudinal end; and two frame ends comprising a rigid sheet-like material, each frame end having a length generally the same as said first length, a height generally the same as said first height, and at least one tab perpendicular to said frame end, said tab being adapted to be removably inserted into said frame so that a box is formed when said tabs of both frame ends are inserted.

2. An insulation unit as in claim 1 wherein each of said frame ends has two tabs along its length, one tab corresponding to said top and one corresponding to said bottom of said frame.

3. An insulation unit as in claim 1 wherein at least one of said frame ends is attached to said bottom with a fold at an intersection of said frame end and said bottom and said tab is inserted into said frame at said top.

4. An insulation unit as in claim 4 wherein said rigid sheet-like material comprises corrugated cardboard.

5. An insulation unit as in claim 1 wherein said plurality of sheets comprises alternating heat-reflective sheets and paper.

6. An insulation unit as in claim 1 wherein said top is covered with a heat-reflective sheet.

7. An insulation unit as in claim 1 wherein said heat-reflective sheet is aluminum foil.

8. An insulation unit as in claim 4 wherein said paper is treated to be flame retardant.

9. An insulation unit as in claim 1 wherein said rigid sheet-like material is treated to be flame retardant.

10. A method of manufacturing an insulation unit for installation in a construction bay which comprises:

forming a frame having a top, a bottom and two sides, said top and said bottom having a first length adapted to closely fit a width of said construction bay and sides having a first height which is generally the same as a depth of said construction bay;

fastening a plurality of sheets having two longitudinal ends to an inside surface of each of said sides in a fixed spaced relationship, one longitudinal end corresponding to each side, at least one sheet of said plurality being a heat-reflective sheet;

forming two frame ends; and inserting said frame ends into said frame perpendicular to said top, said bottom and said sides, each frame end having a length generally the same as said first length, a height generally the same as said first height and at least one tab perpendicular to said frame end adapted for insertion into said frame so that a box is formed when said tabs of both frame ends are inserted.

11. A method as in claim 10 wherein the step of forming said frame ends comprises locating two tabs along said length, one tab corresponding to said top and one corresponding to said bottom of said frame.

12. A method as in claim 10 wherein the step of forming said frame ends includes attaching at least one of said frame ends to said bottom with a fold at an intersection of said frame end and said bottom and inserting said tab into said frame at said top.

13. A method as in claim 10 wherein the step of fastening said plurality of sheets includes selecting alternating heat-reflective sheets and paper.

14. A method as in claim 10 wherein the step of fastening said plurality of sheets includes fastening a single fold at each longitudinal end of each sheet to said inside surface of said side adjacent to said longitudinal end.

15. A method as in claim 10 wherein said top is covered with a heat-reflective sheet.

16. A method as in claim 10 wherein said heat-reflective sheet is aluminum foil.

* * * * *

UNITED STATES PATENT AND TRADEMARK OFFICE

CERTIFICATE OF CORRECTION

PATENT NO. : 5,074,090

DATED : Dec. 24, 1991

INVENTOR(S) : LOUIS HAFERS

It is certified that error appears in the above-identified patent and that said Letters Patent is hereby corrected as shown below:

Column 4, Line 67, "claim 4" should read --claim 1--

Signed and Sealed this

Eleventh Day of May, 1993

*Attest:*

Michael K. Kirk

MICHAEL K. KIRK

*Attesting Officer*

*Acting Commissioner of Patents and Trademarks*